United States Patent [19]

Elmer

[11] 4,347,555

[45] Aug. 31, 1982

[54] COMPOUND BEAM ILLUMINATING

[76] Inventor: William B. Elmer, 2 Chestnut St., Andover, Mass. 01810

[21] Appl. No.: 254,945

[22] Filed: Apr. 16, 1981

Related U.S. Application Data

[62] Division of Ser. No. 49,087, Jun. 18, 1979, Pat. No. 4,288,847.

[51] Int. Cl.[3] ..... F21V 7/00

[52] U.S. Cl. ..... 362/299; 362/300; 362/329; 362/307; 362/347; 362/308; 362/350; 362/310; 362/327; 362/328

[58] Field of Search ..... 362/297, 8, 299, 300, 362/307, 308, 310, 327, 328, 329, 339, 346, 347, 356

[56] References Cited

U.S. PATENT DOCUMENTS

| | | | |
|---|---|---|---|
| 3,169,709 | 2/1965 | Goodbar | 362/297 |
| 3,210,536 | 10/1965 | Elmer | 362/297 |
| 3,383,540 | 5/1968 | Walters | 362/297 X |
| 3,508,809 | 4/1970 | Wilder et al. | 362/297 X |
| 3,622,777 | 11/1971 | Bovio | 362/297 X |
| 3,944,810 | 3/1976 | Grindle | 362/346 X |
| 4,006,355 | 2/1977 | Shemitz | 362/297 X |
| 4,118,763 | 10/1978 | Osteen | 362/337 |
| 4,288,847 | 9/1981 | Elmer | 362/297 |

*Primary Examiner*—Peter A. Nelson
*Attorney, Agent, or Firm*—Charles Hieken

[57] ABSTRACT

A light source is disposed within a light reflector formed to direct a light beam through an open end of the reflector and light controlling means for projecting a modified light beam from the same reflector.

6 Claims, 9 Drawing Figures

COMPOUND BEAM ILLUMINATING

This is a division of application Ser. No. 49,087, filed June 18, 1979, now U.S. Pat. No. 4,288,847.

BACKGROUND OF THE INVENTION

1. Field of the Invention

The invention relates to luminaires, and more particularly, to luminaires of the type having a generally opaque reflector adapted to reduce undesired glare and stray light yet provided with supplemental light modifying means to very substantially improve both the visual utility and the efficiency of the luminaire, and to substantially reduce its first cost, maintenance cost, and energy consumption. The invention applies to space lighting generally, and in particular to both indoor and outdoor lighting, and especially to roadway lighting.

2. Description of the Prior Art

Known roadway lighting commonly includes a luminaire having a light source disposed with a reflector equipped with transparent glassware or a plastic enclosure or a skirt, adapted to control light distribution. In addition, the enclosure is adapted to protect the light source from the natural elements or from vandalism. These enclosures collect dirt, and tend to absorb and redirect some of the light they transmit, in unwanted directions. An appreciable percentage of the light that would otherwise usefully illuminate a roadway is diffused and deflected into unwanted and objectionable directions. For example, some stray light is lost skyward, and some is often redirected toward bedroom windows of nearby residences or at high angles approaching the horizontal causing objectionable glare for drivers of approaching automobiles. These enclosure are very expensive, their production is energy-intensive, and they are generally made unnecessarily heavy in order to reduce breakage by vandalism.

If the roadway luminaire is designed so that the reflector extends down further around the enclosed light source and if the enclosing glassware or plastic were to be entirely omitted, the objectionable glare from a well-designed street luminaire would be almost entirely eliminated. However, such a design would render the light practically invisible at a substantial distance. This disadvantage eliminates the important "beacon effect" that alerts automobile drivers to distant curves in the roadway as they drive at night.

Accordingly, it is an important object of the invention to provide a roadway luminaire having a reflector without glassware or a plastic enclosure. The luminaire substantially minimizes glare by carrying the reflector down around the light source so that no appreciable light is lost beyond the margins of the roadway, nor at vertical angles close to the horizontal, nor upward. It is the teaching of this invention to preserve the beacon effect in such a luminaire by a light aperture in the side or sides of the reflector opposite the enclosed light source, whereby the light source may be seen at a distance without glare or any substantial loss of light.

It is a further object of the invention to assemble a transflector (beam splitter) in such a light aperture in order that some of the light directed toward the aperture will be reflected back usefully, while the remainder will be transmitted toward the roadway.

Known interior lighting is likewise provided commonly with transparent diffusing enclosures, usually flat, or else with glare-shielding louvers, which conceal the lamp itself from view at angles approaching the horizontal, and which augment the downward component of light, but at the cost of a substantial reduction in luminous efficiency.

It is still a further object of the invention to substitute a transflector, or "beam splitter" in place of such louvers or enclosures, in order to suppress all glare without the substantial light losses common to prevailing practice, while at the same time reducing the original and maintenance costs of such lighting.

SUMMARY OF THE INVENTION

According to the invention a luminaire comprises a light source and a generally opaque reflector having an opening that is not necessarily confined to one plane, and associated means for modifying the emitted light in selected directions. The light source is disposed within the reflector for directing the primary light beam through the open end of the reflector in a first principal direction of maximum illumination. In one embodiment light modifying means is formed in a wall of the reflector for directing a secondary light beam in a preferred direction subtantially orthogonal to the principal direction outside the boundaries of the primary light beam. In another embodiment, light modifying means is suspended in the reflector opening. Numerous other features, objects and advantages of the invention will become apparent from the following specification when read in connection with the accompanying drawing in which:

DETAILED DESCRIPTION OF PREFERRED EMBODIMENTS

Figure 1:
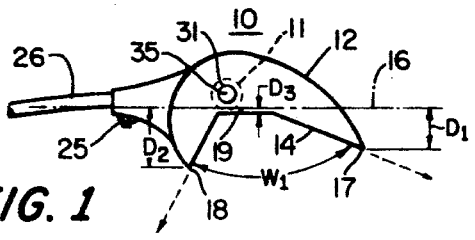
FIG. 1 is a side view of a luminaire adapted for lighting roadways arranged according to the invention.
Figure 2:
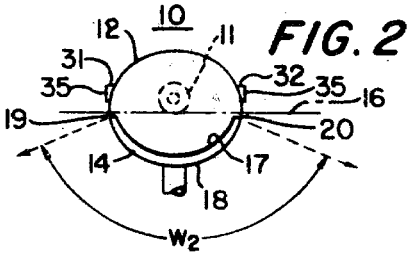
FIG. 2 is a front view of the luminaire shown in FIG. 1.
Figure 3:
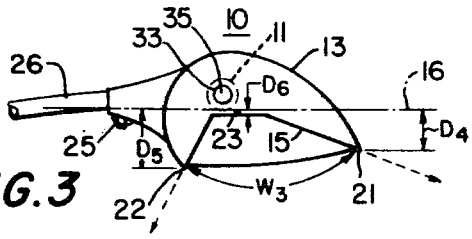
FIG. 3 is a side view of another embodiment of a luminaire arranged according to the invention.
Figure 4:
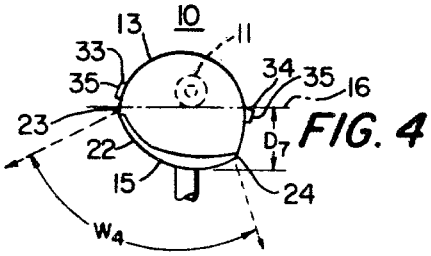
FIG. 4 is a front view of the luminaire shown in FIG. 3.

Referring to FIGS. 1–4, there is shown side and front views of a roadway luminaire 10 including a light source 11 such as an incandescent lamp or bulb mounted within a cavity in an opaque reflector 12, 13. The reflector 12, 13 has a nonplanar rim 14, 15 that extends beyond a horizontal plane 16 of the light source 11 to minimize glare and stray light. The reflector 12, 13 is shaped to reflect and direct a light beam in a preferred direction but with different beam widths in orthogonal planes. As an example, a bidirectional reflector 12 is shown in FIGS. 1 and 2 with front 17 and rear 18 edges of the rim 14 that extend below the horizontal plane 16 of the light source 11 a predetermined distance $D_1$ and $D_2$, respectively, to minimize glare and to collect and reflect additional light from the source 11. The reflector 12 is shaped to reflect the light beam with a first beam width, $W_1$, between the edges 17, 18 in the plane of FIG. 1. The side edges 19, 20 of the rim 14 extend below the horizontal plane 16 of the light source 11 a predetermined distance $D_3$ to also minimize glare. The reflector 12 is shaped to reflect a light beam with a second beam width, $W_2$, between the side edges 19, 20 in the plane of FIG. 2. Another example is a monodirectional ("one-way") reflector 13 shown in FIGS. 3 and 4. Front 21 and rear 22 edges of the monodirectional reflector rim 15 extend below the horizontal plane 16 of the light source 11 a predetermined distance $D_4$ and $D_5$, respectively, to minimize glare and to collect and reflect additional light from the source 11. The monodirectional reflector 13 is shaped to reflect and direct a light beam with a first beam width, $W_3$, between the edges 21, 22 in the plane of FIG. 3. The side edges 23, 24 of the rim 15 extend below the horizontal plane 16 of the light source 11 a distance $D_6$ and $D_7$ to also minimize glare and to collect and reflect additional light from the source 11 in the direction of oncoming traffic to increase apparent pavement brightness. The reflector 13 is shaped to reflect the light beam with a second beam width, $W_4$, between the side edges 23, 24 in the plane of FIG. 4.

Figure 5:
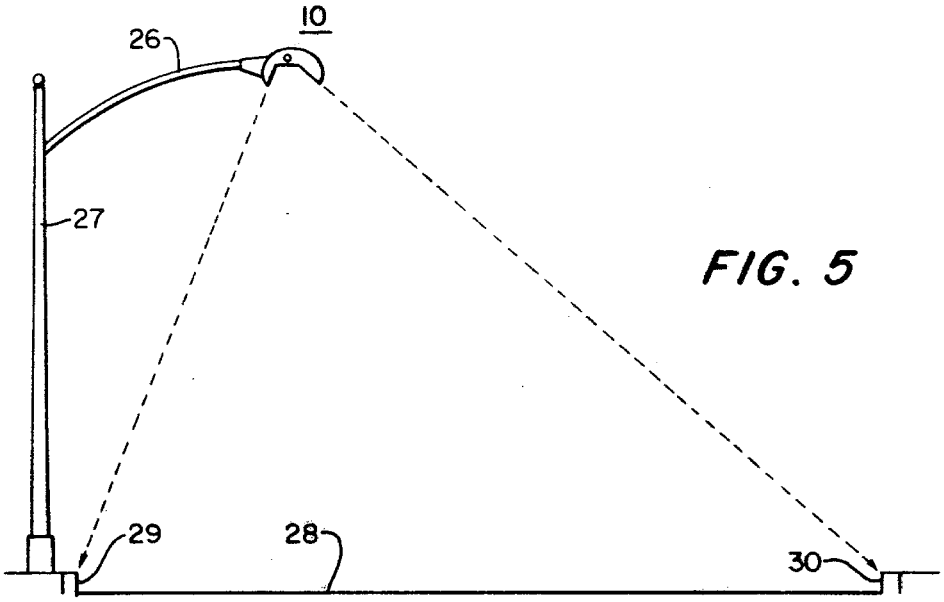
FIG. 5 is the luminaire of FIG. 1 mounted on a pole and suspended over a roadway.

The shape of the reflector 12, 13 is dependent on the application of the luminaire 10. For roadway lighting, the luminaire 10 is attached by a bolt 25 to an arm 26 extending from a pole 27 so as to overhang a roadway 28 by a predetermined distance and height to effectively illuminate between the margins 29, 30 of a roadway 28 as shown in FIG. 5. The bidirectional reflector 12 directs a beam of light toward oncoming traffic traveling along the roadway 28 in either direction, while the monodirectional reflector 13 directs a beam of light substantially toward oncoming traffice traveling along the roadway 28 in only one direction.

Light apertures 31, 32 and 33, 34 are included in at least one opposing sides of each of the reflectors 12, 13 substantially opposite the source 11 so as to direct a small amount of light in a preferred direction with minimum glare, whereby the luminaire 10 can be seen at a distance without redirecting a substantial amount of light away from the roadway 28. The apertures 31, 32 in the opposing sides of the bidirectional reflector 12 are arranged to direct a small amount of light horizontally toward oncoming traffic traveling in both directions. The aperture 33 in the side of the monodirectional reflector 13 is arranged to direct a small amount of light toward oncoming traffic traveling in one direction. The aperture 34 in the other side of the reflector 13 is arranged to direct light beam a short distance beyond the luminaire 10 so that a person or object in the roadway will be illuminated and seen by the drivers of oncoming automobiles.

Figure 6:
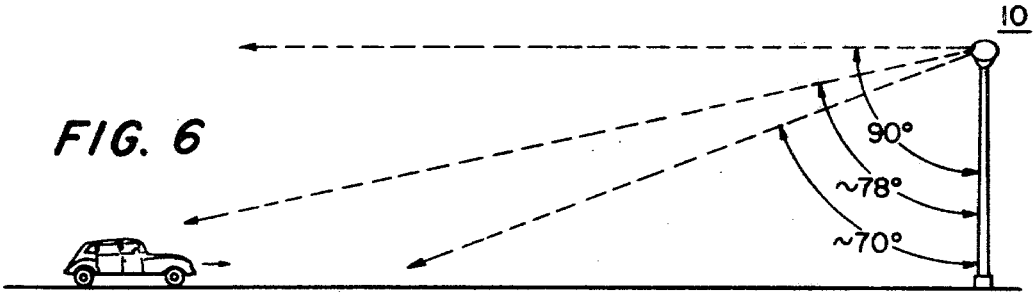
FIG. 6 is a back view of a luminaire showing a light beam from an aperture.

Referring to FIG. 6, there is shown a back view of the luminaire 10 and the beam of light from one of the light apertures 31, or 32, or 33 provided in either of the reflectors 12, 13. The light aperture 31, or 32, or 33 is arranged so that the light beam is visible at 90° from vertical down to a predetermined "upper beam limit" established by the depending lip of the reflector. For small suburban and rural street lights the preferred upper beam limit is 78°. For high intensity street lighting the referred upper beam limit is 70°.

A light moderating means such as a transflector 35, in the form of a partially transparent and partially reflecting member patterned with fine reflecting figurations or other means for splitting the incident beam adapted to contribute to a useful redirection of light by the reflector is assembled in the light apertures 31, 32, 33, 34. The light moderating means minimizes glare of the light from the apertures 31, 32, 33, 34 in more powerful street lights and reflects some of the light back toward the roadway 28. An example of the light moderating means is a glass bullseye. Preferably, a transflecting pattern for illumination should not be so coarse as to produce observable irregularities or striations in the transmitted beam, or in the illumination incident therefrom upon the lighting task.

Figure 7:
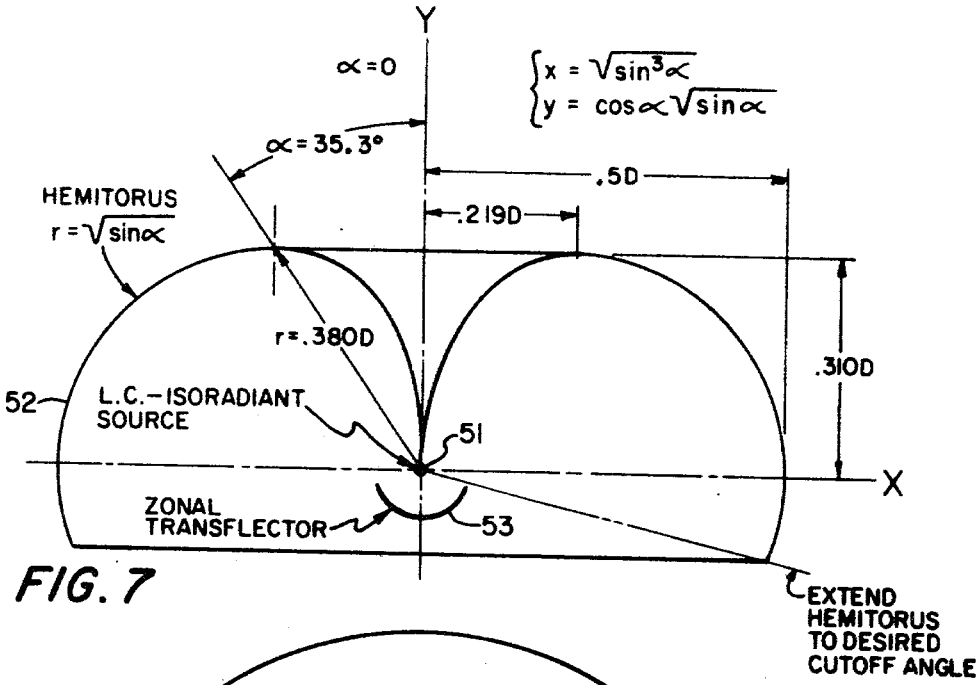
FIGS. 7 and 8 are diagrammatic elevation and plan views, respectively, of a diffuse luminaire adapted for area lighting, said luminaire being of uniform surface brightness according to another aspect of the invention.
Figure 8:
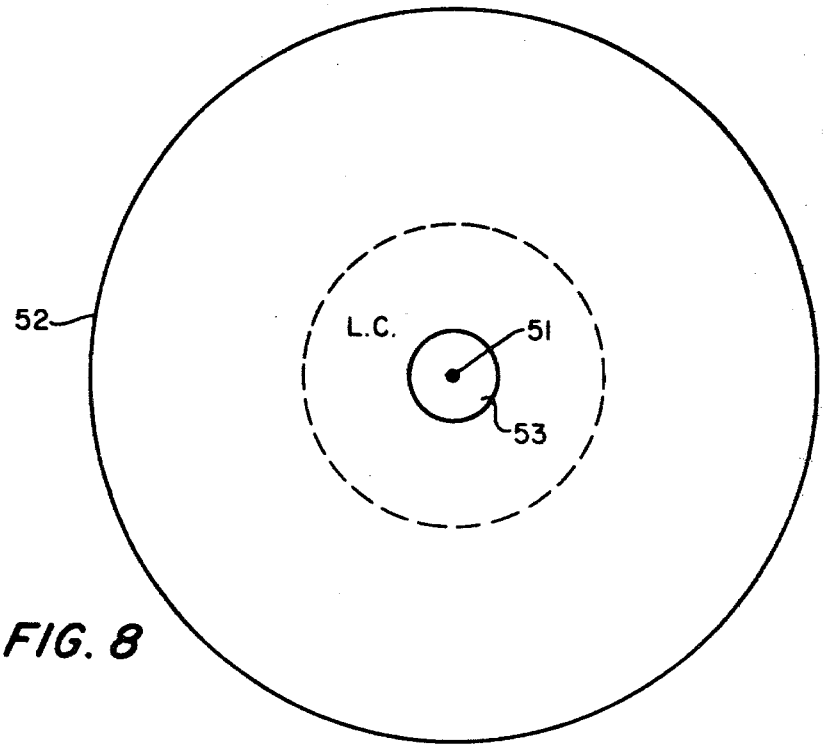

Referring to FIGS. 7 and 8, there is shown diagrammatic elevation and plan views, respectively, of a hemitorus reflector for general area lighting, which is provided with a partially translucent reflecting hemisphere, or transflector mounted beneath the lamp to form a diffuse transmitter-reflector of substantially uniform surface brightness. A light source 51 is located at the center of hemitorus reflector 52 above a zonal transflector 53. The hemitorus reflector 52 has specially curved sections, $r = A\sqrt{\sin \alpha}$ or in parametric form, $x = A (\sin \alpha)^{1.5}$ = radius of hemitorus $y - A (\sin \alpha)^{0.5} \cos \alpha$ = depth of hemitorus, and is illuminated uniformly by the compact isoradiant light source 51 located at the origin. By mount8ng the partially translucent reflecting hemisphere or transflector 53 beneath lamp 51 arranged to transmit enough ight to equal in brightness that reflected by the hemitorus reflector 52, transflector 53 is practically invisible, and the remaining untransmitted flux is reflected back into the hemitorus reflector 52 to reinforce the illumination therefrom. In the specific form illustrated the maximum depth occurs at $\alpha = 35.3°$ from the central axis where the depth is 31.0 percent that of the outside diameter. Skipping (multiple grazing reflections) of the specular rays near the center reduces the uniformity of the reflector brightness to a negligible extent because of the general interflections which enhance the reflector brightness.

Figure 9:
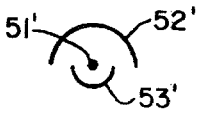
FIG. 9 is a diagrammatic sectional view of another embodiment of the invention comprising a trough reflector.

Diffuse-trough reflectors such as are commonly used for general lighting with fluorescent or other linear lamps interflect less than the bowl types used with compact lamps because the curvature is in one direction only. Furthermore, such reflectors often have flat areas which further reduce interflections. The spherical reflection factor ($\rho_s$) of a trough reflector with continuously curved cross section is between 0.5 and 0.7 that of a bowl reflector of equal $\alpha$, $\rho$ and $\mu$ values. The typical prior art approach of using louvers to avoid glare by lowering the cutoff angle is economically costly and inefficient. Referring to FIG. 9, there is shown a preferred arrangement according to the invention in which an arcuate transflecting channel 53' is suspended under each lamp 51' located along the axis of arcuate reflector 52'.

A diffuse trough reflector of uniform surface brightness has a cross section resembling the elevation view in FIG. 7 except that its two lobes are perfectly circular, where;

$r = A \sin \alpha$ and in parametric form, $x = A \cos^2 \alpha$ = radius of each trough lobe $y = A \sin \alpha \cos \alpha$ = depth of each trough lobe.

In a similar manner the trough 52' is illuminated by a long radially isoradiant lamp 51' and the suspended transflecting arc channel 53' of the proper proportion between transmission and reflection is relatively invisible against the diffuse reflector 52' background. The outer trough edges can be extended downward to provide whatever cutoff angle is desired, with the transflector 53' cut back accordingly to still conceal the lamp 51' from view. Such construction provides ceiling lighting of substantially uniform brightness without glare and without the serious light losses imposed by conventional louvers.

While preferably the transflector permits just enough light through so that its appearance equals the brightness of the reflector behind the lamp so that it becomes relatively invisible, closely approaching uniform ceiling brightness somewhat equivalent to that of a luminous panel set in the ceiling, the transflector may be made with a graduated split ratio in which the light transmitted down could be made stronger than the light transmitted at the higher angles sideways where glare is most serious.

It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Illuminating apparatus comprising, a light source, a relatively opaque diffuse reflector having a principal light emitting opening for reflecting light from said source through said opening in a first primary light beam in a first principal direction of maximum illumination, and transflecting means adjacent to said light source for receiving light therefrom and transmitting a portion of the received light for use by an observer and reflecting back another part of said received light toward the interior of said reflector for illumination reinforcement of said first primary light beam.

2. Illuminating apparatus in accordance with claim 1 comprising a trough reflector of arcuate cross section with a long light source at its center and said transflecting means extending adjacent to said light source for transmitting a portion of the light therefrom through said transflecting means and reflecting the remaining received portion to said reflector for re-reflection toward the area to be illuminated.

3. Illuminating apparatus in accordance with claim 1 wherein the surface brightness of said transflecting means is of substantially the same intensity as the surface brightness of said reflector so that said transflecting means is essentially invisible.

4. Illuminating apparatus in accordance with claim 1 wherein said reflector is a hemitorus reflector and said transflecting means is a partially translucent reflecting hemisphere separated from said hemitorus reflector by said light source.

5. Illuminating apparatus in accordance with claim 4 wherein said hemitorus reflector, said light source and said translucent reflecting hemisphere coact to form a diffuse transmitter-reflector of substantially uniform surface brightness.

6. Illuminating apparatus in accordance with claim 1 wherein said relatively opaque diffuse reflector and said transflecting means coact to form a diffuse transmitter-reflector of substantially uniform surface brightness.

* * * * *